United States Patent [19]

Graham

[11] 4,010,593

[45] Mar. 8, 1977

[54] METHOD FOR PACKAGING BOTTLES

[76] Inventor: Robert H. Graham, E. 1527 Rockwood Blvd., Spokane, Wash. 99203

[22] Filed: June 21, 1976

[21] Appl. No.: 697,857

Related U.S. Application Data

[62] Division of Ser. No. 559,782, March 19, 1975.

[52] U.S. Cl. ..... 53/29; 53/48

[51] Int. Cl.[2] ..... B65B 21/14; B65B 21/22

[58] Field of Search ..... 53/29, 30 R, 32, 40, 53/35, 48, 37, 49, 183, 242, 243, 186; 206/196

[56] References Cited

UNITED STATES PATENTS

| | | | |
|---|---|---|---|
| 2,701,938 | 2/1955 | Murray | 53/48 X |
| 3,073,086 | 1/1963 | Martin et al. | 53/48 X |
| 3,083,510 | 4/1963 | Ganz | 53/48 |
| 3,107,465 | 10/1963 | Cote | 53/48 X |
| 3,491,508 | 1/1970 | Standley | 53/35 |
| 3,519,127 | 7/1970 | Wood | 206/196 |

*Primary Examiner*—Travis S. McGehee
*Assistant Examiner*—Horace M. Culver
*Attorney, Agent, or Firm*—Wells, St. John & Roberts

[57] ABSTRACT

The method utilizes a carton for a group of capped bottles each having a sloping upper neck and a cylindrical lower portion. The carton is formed from a single molded blank. It includes a rectangular top panel having an inner area slightly less than the composite area of the grouped bottles across their caps. Sloping side and end walls lead downwardly from the top panel to engage shoulders of the bottles at intermediate locations along their height. The carton area across this intermediate plane is slightly less than the composite area of the lower portions of the grouped bottles. As the carton is applied over the grouped bottles, the lower ends of the bottles are initially spread because of the restricted area within which the caps are confined at the top of the carton. As the carton is wrapped about the lower portions of the bottles, they are pressed tightly toward one another and returned to parallel upright positions. The carton material is yieldable or compressible to assure production of a tight package without the need for interior partitions.

3 Claims, 9 Drawing Figures

FIG 1
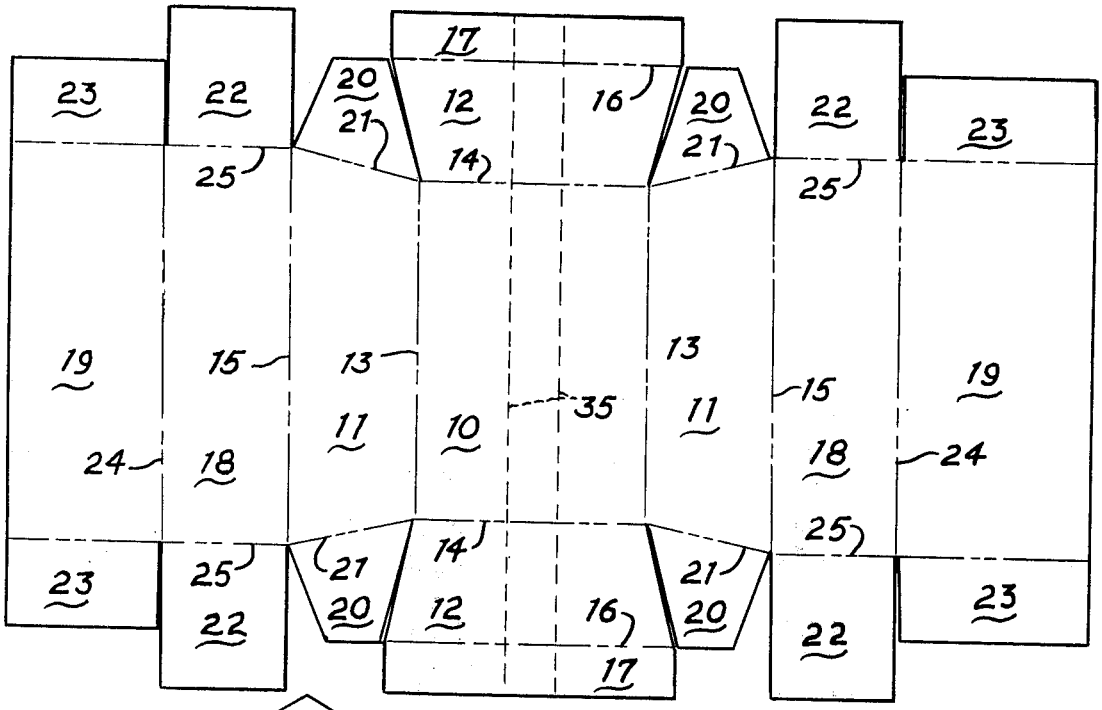
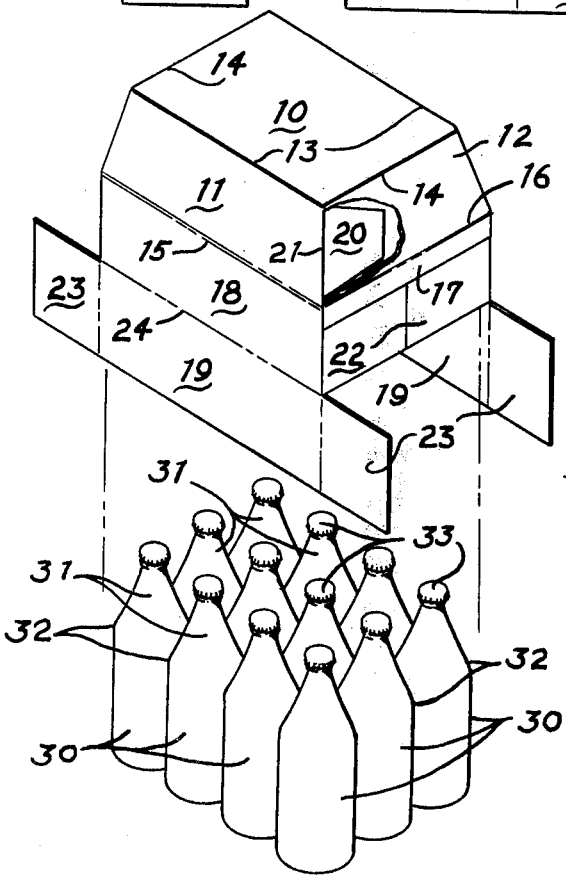
FIG 2
FIG 3
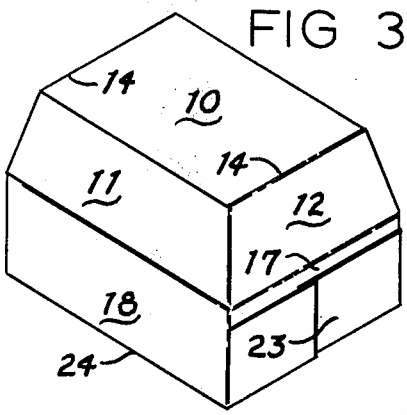

FIG 4
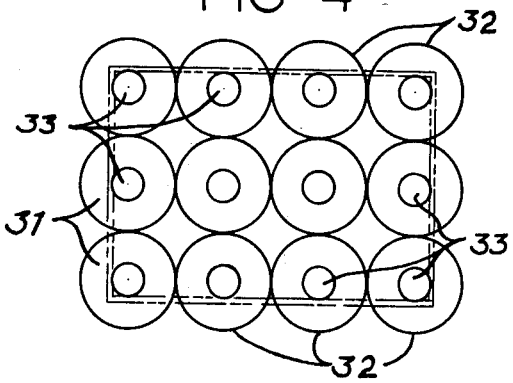
FIG 5
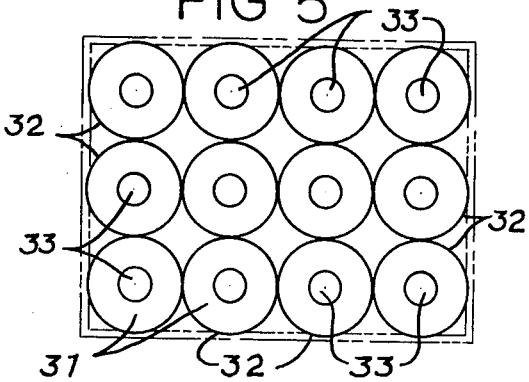
FIG 6
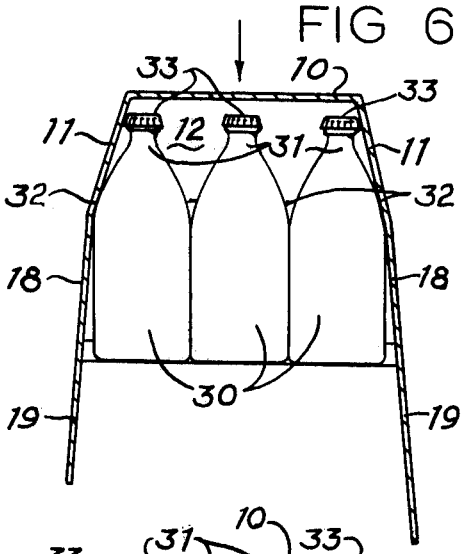
FIG 7
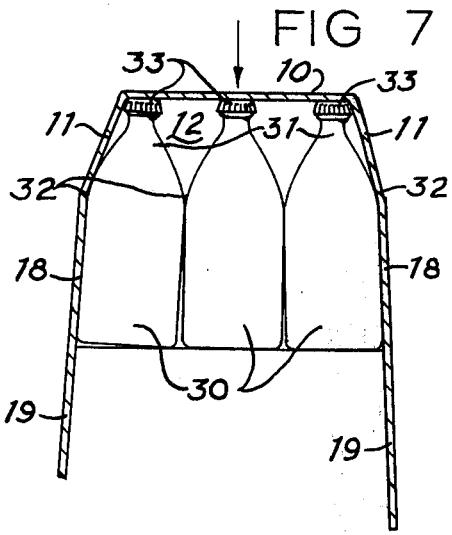
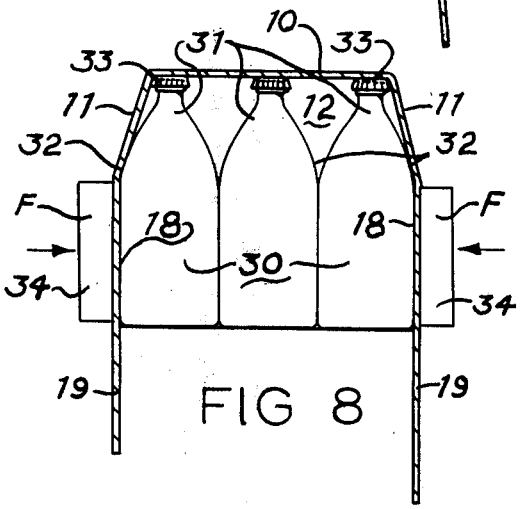
FIG 8
FIG 9
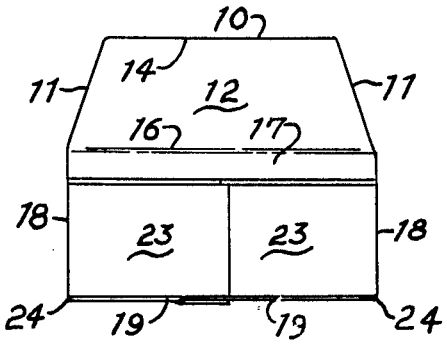

METHOD FOR PACKAGING BOTTLES

RELATED APPLICATIONS

This is a division of application Ser. No. 559,782 filed Mar. 19, 1975 and titled "Bottle Carton".

BACKGROUND OF THE INVENTION

This invention is concerned with production of a simple, economical carton for bottles, particularly designed for capped bottles having sloping necks leading upwardly from shoulder at the top of a cylindrical lower bottle portion. Such bottles are used in the brewing and soft drink beverage industries. The carton design results in considerable material savings in comparison to a normal rectangular carton, and assures tight packing of the bottles against one another and against the carton walls. This eliminates the necessity of an interior partition, which can be used optionally when desired. The carton also provides multi-layer cushioning about the bottles for external protection.

The usual bottle carton has a rectangular configuration and is made from paperboard or corrugated paperboard. In order to provide clearance for normal top-loading of the carton, it is necessary to provide partitions or bottle carriers with dividers between the adjacent bottles. The interior area of such a carton contains considerable unused space, particularly along the upper portions of the bottles where the rectangular corners are spaced at a distance outward from the sloping bottle necks.

Prior bottle carriers and packages have tackled the problem of this unused space, but this has been done primarily with "wrap-around" carriers which are fitted about the bottles in a single operation and which provide only limited bottle protection at the ends of the carrier. Patents showing this general feature are too numerous to fully list, but examples are shown in U.S. Pat. No. 3,186,545 to Conrades; 3,167,214 and 3,152,688 to Mahon; and 3,306,519 to Wood. These patents include cutouts for the caps of the bottles and tabs or dividers to separate individual bottles from one another.

U.S. Pat. No. 3,578,238 shows a rather tight wrap-around carton without cutouts, again formed in a single wrapping operation. This carton is tapered upwardly on all four sides to firmly grasp the bottles. The container shown is a lightweight carrier and not designed for use as a shipping carton. A related carrier construction is shown in U.S. Pat. No. 3,688,972 to Mahon.

U.S. Pat. No. 3,519,127 to Wood shows a carrier open at both ends, and including yieldable apertures in a top panel. The carrier is fitted over the bottles to draw their upper ends together due to the fact that the apertures are spaced apart a distance less than the bottle centers. As the carrier is completed at the bottom of the bottles, the bottles are pulled into a parallel relationship. The apertures are formed with slits along the sides of the carrier to yield as the necks of the bottles move apart.

The carton described herein is designed for shipping of bottles, but is also capable of use as a small carrier package for six or twelve bottles. It is designed to package two or more rows of upright capped bottles. It can be manufactured from relatively stiff corrugated board products. The described method of assembly of the package results in a very tight package with sufficient yieldability and cushioning of the bottles to assure safe shipment without necessitating the use of interior partitions or other dividers between adjacent bottles.

SUMMARY OF THE INVENTION

The method relates to the forming of a package for two or more rows of upright capped bottles from a carton blank having spaced top, bottom and side panels. The carton blank is composed of slightly resilient or compressible materials such as corrugated cardboard or the like. The top panel of each carton blank has an interior length and with slightly less than the total length and width, respectively, across the caps of the bottles. The method comprises the steps of folding and securing upper sloping side and end walls depending from the top panel, locating the resulting enclosure in a downwardly open position above the rows of bottles, placing the blank onto the rows of bottles so that the necks of the bottles are received within the enclosure with the caps engaged against the inner surfaces of the top panel and sloping side and end walls, and urging the bases of the bottles toward one another by wrapping lower side and end wall panels of the carton about them and joining bottom panels of the carton under the bottles to return the bottles to parallel upright positions. The bottles are held tightly within the carton against one another and against the interior carton surfaces by the resilience or compression of the carton material.

DESCRIPTION OF THE DRAWINGS

FIG. 1 is a plan view of the carton blank;

FIG. 2 is a top perspective view of the partially set-up carton and a group of bottles;

FIG. 3 is a top perspective view of the completed carton package;

FIG. 4 is a plan view of the grouped bottles with a superimposed outline of the interior top panel area;

FIG. 5 is a plan view of the grouped bottles with a superimposed outline of the lower interior area along the bottom edges of the inclined side and end wall panels;

FIG. 6 is a transverse sectional view through the carton during initial placement thereof over a group of bottles;

FIG. 7 is a similar transverse sectional view after contact of the bottle cap against the top panel;

FIG. 8 is a similar transverse sectional view illustrating inward compression of the side walls of the carton; and FIG. 9 is a view showing the completed carton.

DESCRIPTION OF THE PREFERRED EMBODIMENT

The carton described herein is produced from a single blank of carton material, such as corrugated paperboard, by conventional stamping machinery or other production methods. The blank outline in a plane configuration is shown in FIG. 1. A partially completed carton in FIG. 2 is in readiness for loading of a group of bottles. FIG. 3 illustrates the completed carbon for shipping and handling purposes.

The carton is designed for reception of a group of bottles such as are used for shipment and sale of beverages. Each bottle has a cylindrical lower portion 30 which joins a sloping neck 31 at an intermediate location along the bottle height, shown as shoulder 32. The shoulder 32 lies in a horizontal plane at which the outer bottle configuration makes a transition from a cylindrical shape to a conical shape. At the upper end of the sloping neck 31 is a cap or other closure 33, having a diameter substantially less than the diameter of the cylindrical lower portion 30 of the bottle.

The illustrated group of bottles is comprised of three rows of four bottles each. However, the carton is designed for reception of two or more rows of bottles, each row containing any reasonable number of bottles as desired. The bottles are located adjacent to one another and normally abut one another along their cylindrical lower portions 30 in both longitudinal and transverse alignment. There are no dividers or partitions shown between the walls of the bottles. For this reason, it is essential that the bottles be tightly packed with a carton to prevent relative movement between the bottles and subsequent damage during shipping or handling. Dividers or partitions can be utilized between the bottles when desired. They would be placed between the grouped bottles before the carton is placed over them.

The carton blank is centered about a rectangular top panel 10. It extends to both sides of top panel 10 to form side walls and bottom panels defined by parallel transverse folds shown at 13, 15, and 24. The side wall panels are formed in two sections illustrated at 11 and 18. The bottom panels are formed in two sections at opposite ends of the blank, indicated at 19. In addition, partial end wall panels are hingedly joined at 14 to opposite ends of top panel 10, and are indicated by numerals 12, 17.

Top panel 10 is designed to contact the upper plane surfaces of caps 33 on the grouped bottles. The length and width dimensions of the top panel 10 (along folds 13, 14), across the inside surfaces of panel 10 are slightly less than the overall length and width across the caps 33 of the group of bottles. This is illustrated in FIG. 4, which schematically indicates the interior dimension of the carton along folds 13 and 14 in relation to the normal upright positions of the grouped bottles received within the carton.

As an illustrative example of the amount of size reduction in the area of the carton panels, a sample carton has been constructed from ⅛ inch thick corrugated paperboard. The normal width across the caps of three bottles was 6⅞ inches. The inside width of the top panel 10 between folds 13 was 6⅝ inches. The general magnitude of reduction is approximately 3 to 5 percent in both length and width dimensions.

A pair of upper side wall panels 11 foldably hinge to top panel 10 along parallel fold lines 13 at the respective sides of panel 10. Each panel 11 is trapezoidal in shape, increasing in width outwardly from fold 13 along side fold lines 21 at each side of the upper sloping side wall panels 11. The slope of panels 11 corresponds substantially to the upright slope of the bottle necks 31. The distance between the outer edge of each side wall panel 11 (shown at fold 15) and its inner edge (shown at fold 13) is substantially identical to the sloping distance along the length of the neck 31 of each bottle between shoulder 32 and the upper surface of cap 33.

At each end of top panel 10 are folds 14, which divide panel 10 and upper sloping end wall panels 12. Panels 12 also are trapezoidal in shape and have the same depth dimension as panels 11. Their outer extremes are indicated by fold lines 16, which divide each panel 12 from a partial lower end wall panel 17.

Continuing outward along the length of the carton blank, lower side wall panels 18 are hingedly joined to panels 11 along folds 15. Each panel 18 is rectangular in shape and has a width corresponding to the maximum or outer width of the trapezoidal panels 11. The distance across panel 18 between its outer fold 24 and inner fold 15 is substantially identical to the height of the lower portion 30 of each bottle.

A pair of complementary bottom panels 19 completes the main portions of the carton blank. They also are rectangular and of a width identical to the width of panels 18. They extend a sufficient distance along the carton blank so as to overlap one another when folded across the bottom of the carton.

To facilitate construction of the carton, angular tabs 20 are foldably joined along fold lines 21 on the sloping sides of each panel 11. They are shaped so as to abut and lie completely within the area of the inner surface of the adjacent end wall panels 12 (FIG. 2). Likewise, rectangular end flaps 22 are joined to each lower side wall panel 18 along fold lines 25. They are adapted to be folded inwardly and to abut the inner surfaces of the partial lower end wall panel 17 at each end of the carton. As can be seen in FIG. 2, the end flaps 22 extend outwardly from fold lines 25 approximately one half the maximum width of the trapezoidal sloping end wall panels 12. Since they have a height equal to that of the side wall panels 18, they initially protrude beneath the lower end wall panels 17 (FIG. 2). When the carton is completed, they are covered by perpendicular bottom panel flaps 23, foldably joined to the bottom panels 19 along fold lines 26 (FIG. 3). Each bottom panel flap 23 extends outward from fold line 26 a distance substantially equal to the difference in height between the height of the lower portion 30 of each bottle and the height of the partial lower end wall panels 17. The assembled carton therefore has a double thickness of material across substantially all of the ends thereof.

The partially assembled carton (FIG. 2) is in the form of a downwardly open enclosure having trapezoidal sloping panels 11 and 12 and open vertical walls comprised of panels 18 and 19 along the sides and panels 17 and flaps 22 along the ends. The flaring upper portion of the partially completed carton has a vertical depth from folds 15, 16 to the inner surface of top panel 10. This depth is substantially equal to the vertical bottle height between shoulder 32 and top surface of cap 33. The length and width of the enclosure at its lower edges (folds 15, 16) is slightly less than the composite or overall length and width of the bottles is at the maximum defined by the cylindrical lower portions 30 of the respective bottles. Again, the difference in dimension is of the order of 3 to 5 percent.

Loading of the carton is schematically illustrated in FIGS. 6–9. While these drawings illustrate a transverse section along a vertical plane through the carton, it is to be understood that the same action also occurs in a longitudinal plane or direction. The spreading and compression of the carton and bottles occurs in both transverse and longitudinal directions, assuring intimate contact by adjacent bottles in longitudinal and transverse alignment with one another.

The carton is designed to be preformed to the configuration shown in FIG. 2. This can be done in available machinery known in the packaging industry as tray-forming machines, which press an open "tray" or carton between a mandrel and peripheral rolls. Suitable adhesive between the abutting surfaces of panels 12, 17, tabs 20, and flaps 22 produce the preformed carton configuration in readiness for placement above a group of bottles as shown in FIG. 2.

As the carton is forced downwardly over the grouped bottles, the open vertical sides of the carton are free to spread slightly to receive the wider lower portions 30 of the bottles. This spreading action protects labels on the bottles, which are usually located below shoulders 32. Initial contact of the carton by the peripheral caps 33 on the grouped bottles will occur along the inside surfaces of the upper sloping side walls 11 and upper sloping end walls panels 12 (FIG. 6) This will occur at a location adjacent the fold line 13 along each side of top panel 10 and along fold line 14 at each end of panel 10. Further downward movement of the carton will result in camming forces being applied to the bottles as the peripheral caps 33 are wedged inwardly within the area bounded by folds 13 and 14 (FIG. 7). Because of the shape of the sloping necks 31, the botles can accommodate the slight restriction in area along the inside surface of top panel 10. They will pivot slightly relative to one another using the abutting shoulders 32 of the bottles as fulcrums. This results in a slight spreading of the lower or bottom ends of the bottles (FIG. 7).

To complete the carton, the sides of the carton are urged toward one another by forces schematically illustrated at F (FIG. 8). These forces can be applied by stationary guides 34 as the cartons move longitudinally, or by rollers or other devices. The forces F bring the walls of the carton below folds 14, 15 to a vertical position. Similar forces are applied to the ends of the carton, and the bottom panels 19 are folded across the bottom of the carton. Bottom panel flaps 23 are then sealed against the outside surfaces of end flaps 22. The compression and sealing of the bottom panels 19 and flaps 23 forces the lower portions 30 of the grouped bottles back into parallel engagement with one another. The expansion of the carton dimensions is accomplished by very slight bulging of the carton, which can be accommodated by the areas along the upright carton corners and by the somewhat resilient or compressible nature of the paperboard or corrugated material itself.

The resulting carton is a very tight integral package of bottles securely abutting one another and encapsulated by a paperboard carton in intimate contact with the sides, top and bottom surfaces of the bottles themselves. Double thicknesses of material are provided at each end of the carton, which has a cushioning, protective effect during shipping and handling. Even more protection can be provided by extending the width of the top panel 10, and panels 12 and 17, to provide an overlapping fold of three thicknesses over the carton and along its sides. The carton material is simply folded back and forth along parallel fold lines to increase its thickness along this area. Such folds are illustrated at dashed lines 35 in FIG. 1, and are secured by adhesive to produce a multiple thickness band across the carton. This band can be continued under the carton by providing a double fold along the overlapping portions of the bottom panel 19 and flaps 23. Reinforcement of the carton can also be obtained by incorporating into the carton elements of high tensile strength tape or other filament. Such tapes are available with glass fibers for strength. The tape can extend longitudinally or transversely about the carton to produce one or more encircling bands for strength purposes. This alternative to the multiple thickness band would facilitate stacking of the completed carton and assure greater strength with less paper substance in the carton.

Tear strips, finger holes and various handle configurations can readily be incorporated into the carton.

The carton blank is designed to provide economical use of paperboard, the total area of the blank being substantially less than that required to produce a rectangular carton. Furthermore, by assuring tight contact between the carton and the bottles within it, the carton eliminates need for interior partitions or dividers between adjacent bottles.

The completed carton (FIG. 3) has an exterior presentation that is composed of large unbroken surface areas on which labels or advertising material can be printed or attached.

Minor changes might be made in the carton design to accommodate the particular configuration of a group of bottles. The above description is intended to serve as an example of the invention, which is set out in the following claims.

Having thus described my invention, I claim:

1. A method of forming a package for two or more rows of upright capped bottles from a carton blank having spaced top, bottom and side panels composed of slightly resilient or compressible material such as corrugated cardboard or the like, the top panel having an interior length and width slightly less than the total length and width, respectively, across the caps of the bottles;

the method comprising the following sequential steps:

a. folding and securing upper sloping side and end walls depending from the top panel to produce an open enclosure having folded edges located in a plane parallel to the top panel;

b. locating the enclosure in a downwardly-open position immediately above the rows of bottles;

c. placing the blank onto the rows of bottles so that the bottle necks are received within the enclosure with the caps engaged against the inner surfaces of the top panel and the respective sloping side and end walls at fold lines connecting them to the top panel, thereby tilting the upper ends of the bottles slightly toward one another;

d. and urging the bases of the bottles toward one another by wrapping lower rectangular side and end wall panels of the carton about them and joining bottom panels of the carton under the bottles to return the bottles to parallel upright positions in engagement with one another within the completed carton;

whereby the bottles within the carton are held tightly against one another and the interior carton surfaces by the resulting resilience or compression of the carton material.

2. A method for packaging two or more rows of upright capped bottles within a carton composed of slightly resilient or compressible material such as corrugated cardboard or the like, wherein the rows of bottles have a predetermined total length and width and the bottles have a common predetermined neck height and total height, and wherein the carton is formed from a single blank having a rectangular top panel for engaging the top cap surfaces on the bottles, the top panel having an interior length and width slightly less than the total length and width, respectively, across the caps of the bottles, and further having upper sloping side and end wall panels connected by fold lines to the side and end edges of the top panel respectively and terminating along lower folded edges parallel to said fold lines;

said method comprising the following sequential steps:

a. folding and securing the upper sloping side and end walls to one another to produce a downwardly-open enclosure with the lower folded edges thereof located in a plane parallel to the top panel, the interior length along the lower folded edges of the upper sloping side wall panels being slightly less than the total length along one row of bottles, and the interior width across the lower folded edges of the upper sloping end wall panels slightly less than the total width of the rows of bottles;

b. locating the downwardly-open enclosure immediately above the rows of bottles;

c. inserting the bottles within the downwardly-open enclosure by moving the bottles and/or enclosure relative to one another until the top cap surfaces of the bottles engage the inner surface of the top panel and the caps of the bottles engage the upper sloping side and end wall panels at the fold lines connecting them to the top panel, causing the bottles to spread outward at their bases;

d. and urging the bases of the bottles toward one another by wrapping lower rectangular side and end wall panels of the carton under the bottles to return the bottles to parallel upright positions in engagement with one another within the completed carton;

whereby the bottles within the carton are held tightly against one another and the interior carton surfaces by the resulting resilience or compression of the carton material.

3. A method of packaging a group of two or more rows of upright capped bottles, the bottles each having a substantially cylindrical lower portion which joins a sloping neck at an intermediate location along the bottles height, the bottles being adjacent one another in longitudinal and transverse alignment, said method comprising the following steps:

a. partially forming a carton having a rectangular top panel with an inner length and width slightly less than the overall length and width, respectively, across the caps of the grouped bottles, downwardly flaring side and end wall panels foldably jointed to the top panel and forming a downwardly-open enclosure having an interior depth equal to the bottle height upwardly from said intermediate location and having an interior length and width at its lower edges slightly less than the length and width respectively, of the combined lower portions of the grouped bottles, said carton being completed by lower side and end wall panels and bottom panels;

b. locating the enclosure in a downwardly open position immediately above the rows of bottles;

c. forcing the carton over the group of bottles so as to cause the caps of the bottles to contact the flaring side and end wall portions prior to contact of the top panel, whereby the lower ends of the bottles are then spread apart slightly as continued force is applied to move the carton over the bottles; and d. compressing the lower side and end wall portions of the carton while wrapping the bottom panels under the bottles prior to sealing of the bottom panels, to thereby bring the bottles back to parallel upright positions in engagement with one another within the carton.

* * * * *